US006121943A

United States Patent [19]

Nishioka et al.

[11] Patent Number: 6,121,943

[45] Date of Patent: Sep. 19, 2000

[54] ELECTROLUMINESCENT DISPLAY WITH CONSTANT CURRENT CONTROL CIRCUITS IN SCAN ELECTRODE CIRCUIT

[75] Inventors: Ken Nishioka, Toyoake; Hiroyuki Kishita, Kariya; Masahiko Osada, Hekinan, all of Japan

[73] Assignee: DENSO Corporation, Kariya, Japan

[21] Appl. No.: 08/855,396

[22] Filed: May 13, 1997

Related U.S. Application Data

[63] Continuation-in-part of application No. 08/675,672, Jul. 3, 1996, Pat. No. 5,847,516.

[30] Foreign Application Priority Data

| | | | |
|---|---|---|---|
| Jul. 4, 1995 | [JP] | Japan | 7-168882 |
| Aug. 11, 1995 | [JP] | Japan | 7-206344 |
| Aug. 11, 1995 | [JP] | Japan | 7-206345 |
| May 13, 1996 | [JP] | Japan | 8-117979 |

[51] Int. Cl.[7] ..... G09G 3/30

[52] U.S. Cl. ..... 345/76; 345/79; 345/209; 345/212; 315/169.3

[58] Field of Search ..... 345/76, 79, 204, 345/208, 209, 210, 211, 212; 315/169.1, 169.3

[56] References Cited

U.S. PATENT DOCUMENTS

| | | | |
|---|---|---|---|
| 4,338,598 | 7/1982 | Ohba et al. | 345/76 |
| 4,443,741 | 4/1984 | Tanaka et al. . | |
| 4,485,379 | 11/1984 | Kinoshita et al. | 345/79 |
| 4,797,667 | 1/1989 | Dolinar et al. | 345/76 |
| 4,864,182 | 9/1989 | Fujioka et al. | 315/169.3 |
| 4,866,348 | 9/1989 | Harada et al. | 345/209 |
| 4,888,523 | 12/1989 | Shoji et al. | 345/209 |
| 4,999,618 | 3/1991 | Inada et al. | 345/79 |
| 5,463,283 | 10/1995 | Sanderson . | |
| 5,629,716 | 5/1997 | Okamoto et al. | 345/60 |
| 5,847,516 | 12/1998 | Kishita et al. | 315/169.3 |

FOREIGN PATENT DOCUMENTS

| | | |
|---|---|---|
| 54-53981 | 4/1979 | Japan . |
| 54-53982 | 4/1979 | Japan . |
| 54-55118 | 5/1979 | Japan . |
| 54-92081 | 7/1979 | Japan . |
| 58-161418 | 9/1983 | Japan . |
| 60-15078 | 4/1985 | Japan . |
| 61-34597 | 2/1986 | Japan . |
| 62-509 | 1/1987 | Japan . |
| 1-20433 | 4/1989 | Japan . |
| 1-20434 | 4/1989 | Japan . |
| 5-249916 | 9/1993 | Japan . |
| 5-333815 | 12/1993 | Japan . |
| 7-65953 | 3/1995 | Japan . |
| 7-58635 | 6/1995 | Japan . |
| 7-271326 | 10/1995 | Japan . |

*Primary Examiner*—Dennis-Doon Chow
*Assistant Examiner*—Amr Awad
*Attorney, Agent, or Firm*—Pillsbury Madison & Sutro LLP

[57] ABSTRACT

To reduce the influence of generation of heat at scan driver ICs during the application of a scan signal with reduced time of charge and discharge and to eliminate the problem of a rush current, in an EL display where scan driver Ics sequentially apply a scan signal to a plurality of scan electrodes and data driver IC applies a data signal to data electrodes to selectively cause EL elements to emit light responsive to the scan signal and data signal, constant current control circuits are provided to control charge and discharge currents at constant currents during the application of the scan signal to the scan electrodes by the scan driver ICs.

18 Claims, 8 Drawing Sheets

POSITIVE FIELD
NEGATIVE FIELD 51.62

52.61

21a

21b

31a

31b

201
Vs+Vm
Vm
0
-Vs

301
Vs+Vm
Vm
0
-Vs

401
Vm
0

111
Vs+Vm
Vm
0
-(Vs+Vm)
-Vm

121
Vm
Vs
0
-Vm
-Vs

Vs+Vm
L1
0

Vm
L2
-Vs

POSITIVE FIELD
NEGATIVE FIELD

84a

85a

83a

86a

21a

31a

21b

31b

201
Vs+Vm
Vm
0
-Vs

301
Vs+Vm
Vm
0
-Vs

401
Vm
0

111
Vs+Vm
Vm
0
-Vm
-(Vs+Vm)

121
Vm
Vs
0
-Vm
-Vs

Vs+Vm
L1
0

Vm
L2
-Vs

POSITIVE FIELD
NEGATIVE FIELD 51,62

52,61

21a

21b

31a

31b

201
Vs+Vm
Vm
0
-Vs

301
Vs+Vm
Vm
0
-Vs

401
Vm
0

111
Vs+Vm
Vm
0
-Vm
-(Vs+Vm)

121
Vm
Vs
0
-Vm
-Vs

91a

92a

Vs+Vm
L1
0

Vm
L2
-Vs

ELECTROLUMINESCENT DISPLAY WITH CONSTANT CURRENT CONTROL CIRCUITS IN SCAN ELECTRODE CIRCUIT

CROSS-REFERENCE TO RELATED APPLICATIONS

This application is a continuation-in-part of U.S. patent application Ser. No. 08/675,672 filed Jul. 3, 1996, now U.S. Pat. No. 5,847,516, incorporated herein by reference. This application also claims foreign priority from Japanese Patent Application No. Hei 8-117979 and is further related to Japanese Patent Application Nos. Hei 7-168822, 7-206344 and 7-206345, all four of which also are incorporated by reference.

BACKGROUND OF THE INVENTION

1. Field of the Invention

The present invention relates to an EL display for performing display by driving EL (electro-luminescence) elements for emission of light.

2. Description of Related Art

Conventional circuits for driving EL elements for emission of light include the one disclosed in Japanese Patent Publication Laid-Open No. Hei 5-333815. This circuit has an EL display panel on which a plurality of scan electrodes and a plurality of data electrodes are arranged in a matrix and EL elements formed in positions where the scan electrodes and data electrodes intersect with each other. Scan driver ICs sequentially apply a scan signal to the plurality of scan electrodes and data driver ICs apply a data signal to the data electrodes to selectively cause the plurality of EL elements to emit light responsive to the scan signal and data signal.

In the above-described configuration, the scan driver ICs have FETs at their output stages, and charge and discharge currents are supplied to the scan electrodes through the FETs to charge and discharge the EL elements, which results in the application of the scan signal to the scan electrodes. When the scan signal is applied, a problem arises in that the scan driver ICs are significantly affected by generation of heat because the values of the charge and discharge currents are very high. Further, since a rush current flows at the time of charge and discharge, a problem arises in that the scan driver ICs are damaged when the rush current exceeds an allowable current of the scan driver ICs.

Although resistors may be inserted in the circuits for charge and discharge in order to eliminate such problems, this increases the time constant of the charging and discharging, resulting in the problem of an increase in charging and discharging time.

SUMMARY OF THE INVENTION

It is an object of the present invention to solve the problems associated with the generation of heat and the rush current during the application of the scan signal while reducing the charging and discharging time.

The above object is achieved according to an aspect of the invention by providing an EL display where scan driver ICs sequentially apply a scan signal to a plurality of scan electrodes and data driver IC applies a data signal to data electrodes to selectively cause EL elements to emit light responsive to the scan signal and data signal, constant current control circuits are provided to control charge and discharge currents at constant currents during the application of the scan signal to the scan electrodes by the scan driver ICs.

Other objects and features of the present invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

Figure 1:
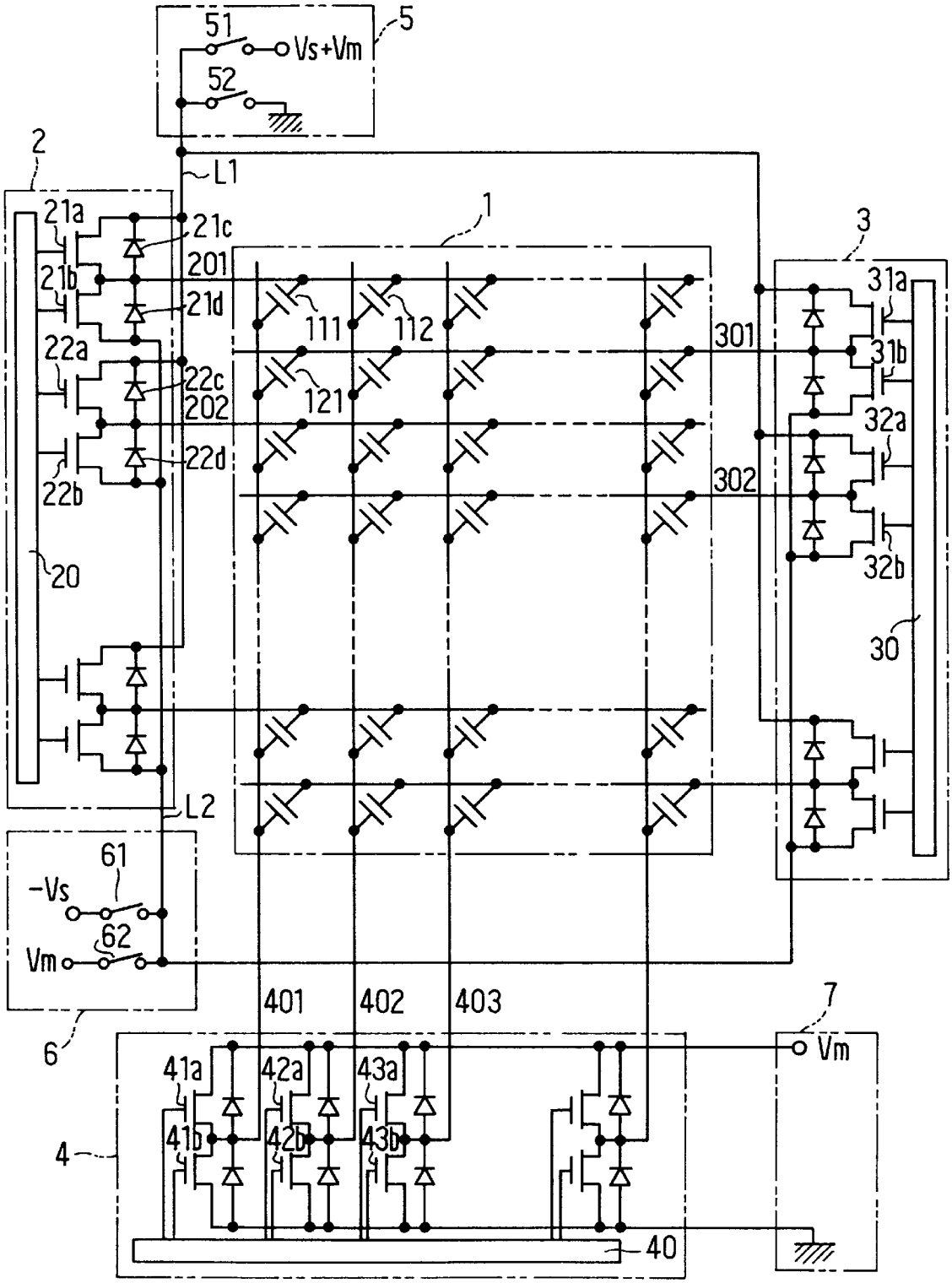
FIG. 1 is a general configuration diagram showing a configuration of an EL display representing a first preferred embodiment of the present invention.
Figure 2:
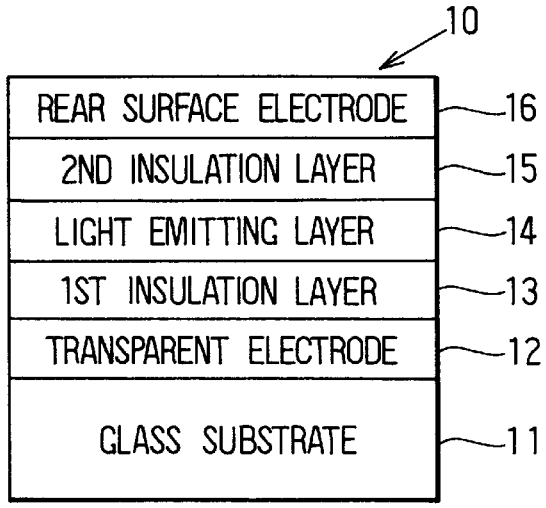
FIG. 2 is a cross-sectional view showing a configuration of an EL element in the first embodiment.

FIG. 1 shows a general configuration of an EL display representing a first preferred embodiment of the present invention. FIG. 2 shows a schematic sectional configuration of an EL element in the embodiment.

In FIG. 2, an EL element 10 includes a transparent electrode 12, a first insulation layer 13, a light-emitting layer 14, a second insulation layer 15, and a backside electrode 16 formed on a glass substrate 11 in the form of laminated layers and emits light in response to the application of an AC voltage pulse between the transparent electrode 12 and backside electrode 16. In FIG. 2, light is emitted from the glass substrate 11. If the backside electrode 16 is a transparent electrode, light can be emitted out in both of upward and downward directions in the Figure.

The EL display panel 1 shown in FIG. 1 has a configuration that is based on the configuration shown in FIG. 2, where a plurality of transparent electrodes 12 and a plurality of backside electrodes 16 are arranged in a matrix to serve as scan electrodes and data electrodes, respectively, and wherein EL elements are arranged in a matrix to perform display. Specifically, odd-numbered scan electrodes 201, 202, . . . and even-numbered scan electrodes 301, 302, . . . are formed in the direction of the rows and data electrodes 401, 402, 403, . . . are formed in the direction of the columns.

El elements 111, 112, . . . 121 as pixels are formed in regions where the scan electrodes 201, 301, 202, 302, . . . and the data electrodes 401, 402, 403, . . . respectively intersect with each other. Since EL elements are capacitive elements, FIG. 1 indicates them by the symbol normally used for capacitors.

In order to drive the EL display panel 1 for display, scan driver ICs 2 and 3 as scan electrode driving circuits and a data driver IC 4 as a data electrode driving circuit are provided.

The scan driver circuit IC 2 is a push-pull type driving circuit which includes p-channel FETs 21*a*, 22*a*, . . . and n-channel FETs 21*b*, 22*b*, . . . connected to the odd-numbered scan electrodes 201, 202, . . . and which applies a scan signal to the odd-numbered scan electrodes 201, 202, . . . in accordance with the output of a control circuit 20.

Further, the FETs 21*a*, 21*b*, 22*a*, 22*b*, . . . are formed with parasitic diodes 21*c*, 21*d*, 22*c*, 22*d*, . . . , respectively, to set the scan electrodes at a desired reference voltage.

The scan driver IC 3 has a similar configuration including a control circuit 30, p-channel FETs 31*a*, 32*a*, . . . and n-channel FETs 31*b*, 32*b*, . . . and supplies a scan signal to the even-numbered scan electrodes 301, 302, . . .

The data driver IC 4 similarly includes a control circuit 40, p-channel FETs 41*a*, 42*a*, . . . and n-channel FETs 41*b*, 42*b*, . . . and supplies a data signal to the data electrodes 401, 402, 403, . . .

Scan signal supply circuits 5 and 6 supply the scan signal to the scan driver ICs 2 and 3. The scan signal supply circuit 5 includes switching elements 51 and 52 and supplies a write voltage (Vs+Vm) or ground voltage to a common line L1 at the source side of p-channel FETs of the scan driver ICs 2 and 3 in accordance with on and off states of the switching elements. The scan signal supply circuit 6 includes switching elements 61 and 62 and supplies a voltage −Vs or an offset voltage Vm to a common line L2 at the source side of n-channel FETs of the scan driver ICs 2 and 3 in accordance with on and off states of the switching elements.

A data signal supply circuit 7 supplies the data signal to the data driver IC 4. The data signal supply circuit 7 supplies a modulated voltage Vm to a common line on the source side of the p-channel FET of the data driver IC 4 and supplies a ground voltage to a common line on the source side of the n-channel FET.

The scan signal supply circuits 5 and 6 are not required to provide an offset voltage which is the same as the modulated voltage Vm but may provide a voltage of another value.

In order to cause the EL elements to emit light in the above-described configuration, an AC voltage pulse must be applied between the scan electrodes and data electrodes. Therefore, driving is performed by producing a voltage pulse for each scan line whose polarity is inverted between positive and negative polarities in each field.

A description will now be made on operations in positive and negative fields with reference to the timing charts shown in FIGS. 3A–3M. In these timing charts and the timing charts in FIGS. 7A–7O and 9A–9O to be described later, on and off states are shown as high and low levels, respectively, for switching elements 51, 52, 61, and 62 and FETs 21*a*, 21*b*, 31*a*, 31*b*, 83*a*, 84*a*, 85*a*, 91*a*, and 92*a*. Voltage waveforms of scan electrodes and the like are shown as having no rounding of waveforms.

Positive Field

Figures 3A, 3B, 3C, 3D, 3E, 3F, 3G, 3H, 3I, 3J, 3K, 3L, 3M:
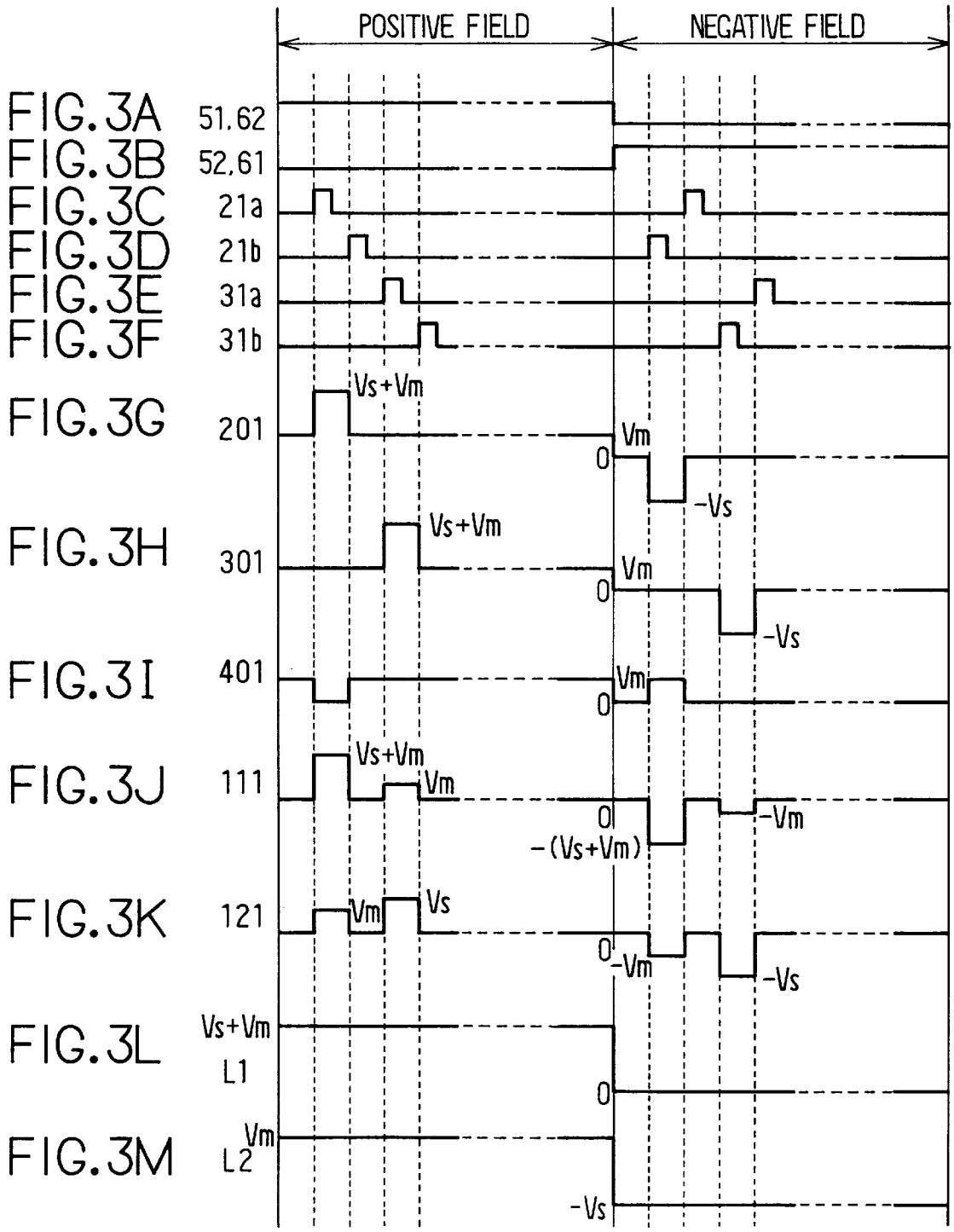
FIGS. 3A–3M are timing charts for the first embodiment.

The switching elements 51 and 62 are turned on as shown in FIG. 3A, and the switching elements 52 and 61 are turned off as shown in FIG. 3B. At this time, reference voltages of the scan electrodes 201, 301, 202, 302, . . . equal the offset voltage Vm as a result of the operation of the parasitic diodes 21*d*, 22*d*, . . . of the FETs of the scan driver ICs 2 and 3. Further, the FETs 41*a*, 42*a*, 43*a*, . . . of the data driver IC 4 are turned on to set the voltage of the data electrodes at Vm. In this state, the voltage applied to all EL elements is 0 V and, therefore, no light is emitted by the EL elements.

Thereafter, a light emitting operation in the positive field is started. First, the p-channel FET 21*a* of the scan driver IC 2 connected to the scan electrode 201 for the first row is turned on to set the voltage of the scan electrode 201 at (Vs+Vm) as shown in FIG. 3G. Further, all of the FETs at the output stages of the scan driver ICs 2 and 3 connected to other scan lines are turned off to put those scan electrodes in a floating state.

Further, the p-channel FETs and n-channel FETs of the data driver IC 4 connected to the data electrodes for the EL elements to be caused to emit light among the data electrodes 401, 402, 403, . . . are turned off and on, respectively, and the p-channel FETs and n-channel FETs of the data driver IC 4 connected to the data electrodes for the EL elements not to be caused to emit light are turned on and off, respectively.

Since the voltage of the data electrodes for the EL elements to be caused to emit light is thus set at the ground voltage, the voltage (Vs+Vm) which is above a threshold voltage is applied to the EL elements to cause the EL elements to emit light as shown in FIG. 3J. Meanwhile, the voltage of the data electrodes for the EL elements not to be caused to emit light is kept at Vm, and the voltage Vs is applied to such EL elements as shown in FIG. 3K. This voltage Vs is set lower than the threshold voltage and, therefore, the EL elements do not emit light.

The timing charts in FIGS. 3A–3M show a state wherein the p-channel FET 41*a* and n-channel FET 41*b* of the data driver IC 4 are turned off and on, respectively, as shown in FIG. 3I to apply the voltage (Vs+Vm), thereby causing the EL element 111 to emit light.

Thereafter, the p-channel FET 21*a* and n-channel FET 21*b* of the scan driver IC 2 connected to the scan electrode 201 for the first row are turned off and on, respectively, as shown in FIG. 3G to discharge the charge accumulated in the EL elements on the scan electrode 201.

Next, the p-channel FET 31*a* of the scan driver IC 3 connected to the scan electrode 301 for the second row is turned on as shown in FIG. 3H to set the voltage of the scan electrode 301 at (Vs+Vm). Further, all of the FETs at the output stages of the scan driver ICs 2 and 3 connected to other scan electrodes are turned off to put those scan electrodes in a floating state.

The voltage levels of the data electrodes 401, 402, 403, . . . are set at voltage levels that depend on the EL elements to emit light and the EL elements not to emit light to drive the EL elements for the second low for emission of light in the same manner as that described above.

The timing charts in FIGS. 3A–3M show a state wherein the p-channel FET 41*a* and n-channel FET 41*b* of the data driver IC 4 are turned on and off, respectively, as shown in FIG. 3I to set the voltage of the data electrode 401 at Vm and to apply the voltage Vs to the EL elements 121 as shown in FIG. 3K, thereby preventing the EL element 121 from emitting light.

Thereafter, the p-channel FET 31*a* and n-channel FET 31*b* of the scan driver IC 3 connected to the scan electrode 301 for the second row are turned off and on, respectively, to discharge the charge accumulated in the EL elements on the scan electrode 301.

Subsequently, the above-described operation is repeated up to the last scan line in the same manner to perform line sequential scanning.

Negative Field

The switching elements 52 and 61 are turned on and the switching elements 51 and 62 are turned off as shown in FIGS. 3A and 3B to perform an operation similar to that in the positive field with the polarity inverted. At this time, the reference voltage of the scan electrodes equals the ground voltage as a result of the operation of the parasitic diodes 21*c*, 22*c*, . . . of the scan driver ICs 2 and 3. The FETs 41*b*, 42*b*, 43*b*, . . . of the data driver ICs 4 are turned on to set the voltage of the data electrodes at the ground voltage. In this state, no EL elements emit light because the voltage applied to all of the EL elements is 0 V.

Thereafter, line sequential scanning is performed in the negative field in a manner similar to that in the positive field.

In this case, a voltage −Vs is applied to the scan electrodes for a row which is selected for display. Referring to the data electrodes, in contrast to the operation in the positive field, the voltage of the data electrodes to cause emission of light is set at Vm with the data electrodes not to cause emission of light left at the ground voltage.

Therefore, when the voltage Vm is applied to the data electrodes associated with scan electrodes to which the voltage −Vs is applied, a voltage of −(Vs+Vm) is applied to the EL elements associated therewith as shown in FIG. 3K to cause the EL elements to emit light. Further, if the voltage of the data electrodes is the at the ground voltage, the EL elements do not emit light because the voltage −Vs lower than the threshold is applied to the EL elements as shown in FIG. 3K.

The driving in the positive and negative fields as described above completes one cycle of display operation which is thereafter repeated.

As apparent from the operation described above, the voltage Vs is applied to the scan driver ICs in both of the positive and negative field. In the prior art disclosed in Japanese Patent Publication Laid-Open No. Hei 5-33815, since a ground voltage is used in the absence of an offset voltage Vm, a voltage (Vs+Vm) is applied to scan driver ICs during driving in a positive field, which results in the need to set a withstand voltage equal to or higher than that voltage. In the above-described configuration, however, the use of offset voltage Vm allows the withstand voltage of the scan driver ICs 2 and 3 to be lower than that in the prior art by an amount corresponding to the offset voltage, which makes it possible to reduce the withstand voltage of the scan driver ICs 2 an 3.

Further, since the offset voltage Vm serves as a reference voltage and is changed to the driving voltage (Vs+Vm) in the positive field, the change in the voltage can be made small compared to that in the prior art. This allows the rush current flowing into the El elements to be reduced to improve the reliability of the EL elements.

Figure 4:
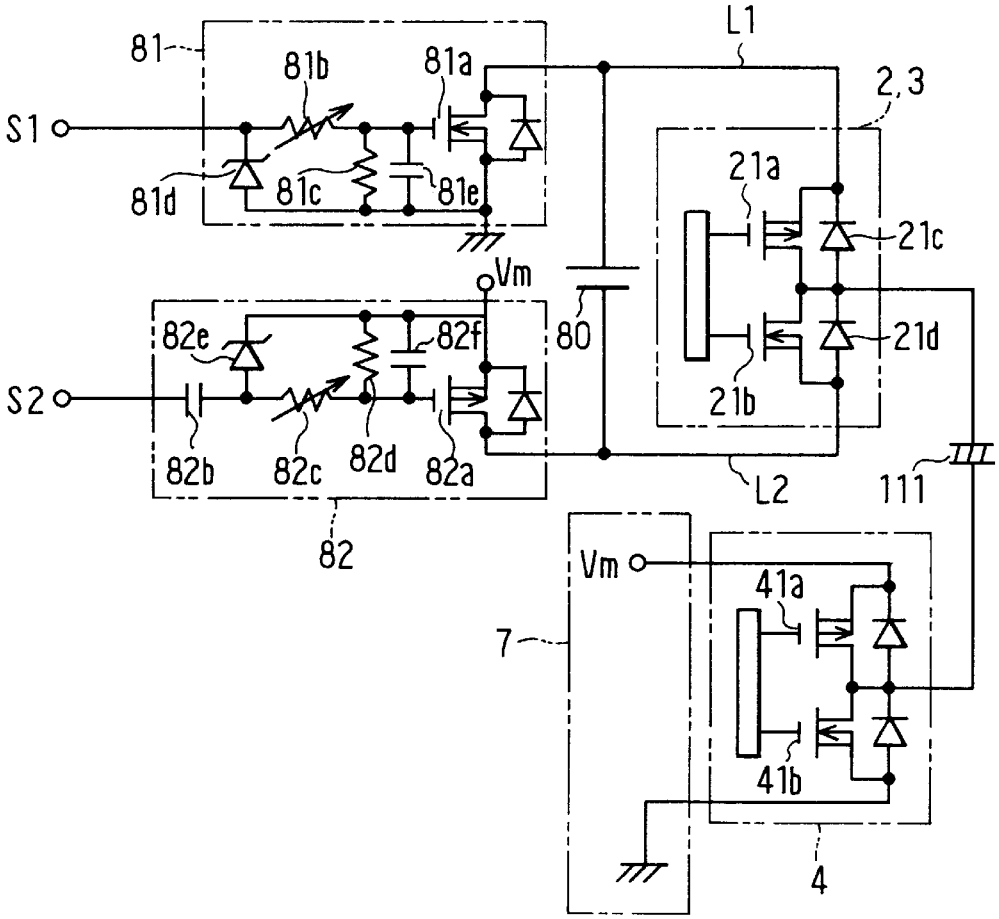
FIG. 4 is a schematic diagram showing a configuration of voltage supply circuits in the first embodiment.

A specific configuration of the above-described scan signal supply circuits 5 and 6 will now be described with reference to FIG. 4. For convenience of description, FIG. 4 shows a configuration of a driving portion for a single EL element 111.

The scan signal supply circuits 5 and 6 have a configuration including a voltage source 80 having the voltage Vs and two constant current control circuits 81 and 82.

The constant current control circuit 81 includes an n-channel FET 81*a* to the gate of which a control signal from an input terminal S1 is provided. The gate-source voltage of this n-channel FET 81*a* is set so that when a control signal at a high level (5 V) is input from the input terminal S1, it is decreased to a predetermined voltage lower than 5 V as a result of voltage division by the resistance of variable resistor 81*b* and a resistor 81*c*. As a result, drain current characteristics relative to the gate-source voltage of the n-channel FET 81*a* keep the drain current at a constant value. Thus, the constant current control circuit 81 performs control to provide a constant current in response to the control signal at a high level input from the input terminal S1.

The constant current control circuit 82 includes a p-channel FET 82*a* to the gate of which a control signal is provided from an input terminal S2 through a coupling capacitor 82*b*. When a control signal at a low level (0 V) is input from the input terminal S2, since the gate-source voltage of this p-channel FET 82*a* is set at a predetermined voltage between 0 V and 5 V as a result of voltage division by the resistance of a variable resistor 82*c* and resistor 82*d*, the drain current of the p-channel FET 82*a* is kept at a constant value. Thus, the constant current control circuit 82 performs control to provide a constant current in response to the control signal at a low level input from the input terminal S2.

81*d* and 82*e* designate Zener diodes for protecting the input, and 81*e* and 82*f* designate capacitors for removing noise.

In the above-described configuration, the control signal at a low level is input from the input terminals S1 and S2 in the positive field. At this time, the n-channel FET 81*a* is turned off and the p-channel FET 82*a* is turned on. As a result, the voltage on the common line L1 at the source side of the p-channel FET becomes (Vs+Vm) which is the sum of the voltages Vm and Vs, and the voltage on the common line L2 at the source side of the n-channel FET becomes Vm.

In the positive field, charge and discharge currents are supplied to each scan electrode using such voltages to charge and discharge the EL elements. In this case, the charge and discharge currents are constant because the drain current of the p-channel FET 82*a* is controlled at a constant current.

The constant current control as described above allows heat generated by the charge and discharge currents to be shared by not only the scan driver ICs 2 and 3 but also the p-channel FET 82*a*. This allows the scan driver ICs 2 and 3 to be less affected by generation of heat. Further, it is also possible to eliminate the rush current at the time of charge and discharge by means of the constant current control.

In the negative field, the control signal at a high level is input from the input terminals S1 and S2. At this time, the n-channel FET 81*a* is turned on, and the p-channel FET 82*a* is turned off. As a result, the voltage on the common line L1 at the source side of the p-channel FET becomes the ground voltage, and the voltage on the common line L1 at the source side of the n-channel FET becomes −Vs.

In this negative field, the drain current of the n-channel FET 81*a* is also controlled at a constant current. As a result, the charge and discharge currents are constant. This makes it possible to reduce and the influence of generation of heat and to eliminate the rush current as described above.

A second embodiment of the present invention will now be described.

Figure 5:
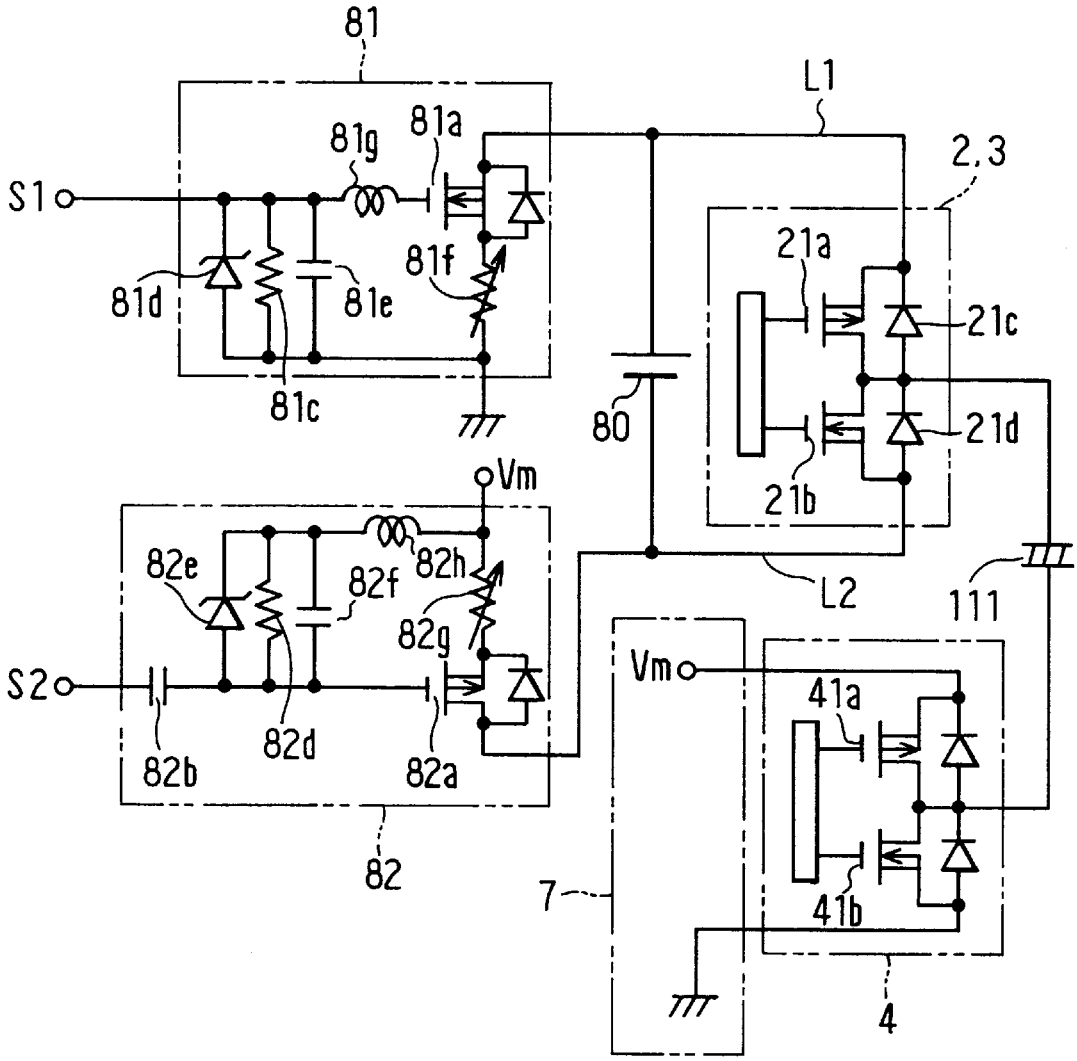
FIG. 5 is a schematic diagram showing a configuration of voltage supply circuits in a second preferred embodiment of the present invention.

FIG. 5 shows another configuration of the constant current control circuits 81 and 82. In the configuration shown in FIG. 5, constant current control is performed by detecting the drain current. Specifically, variable resistors 81*f* and 82*g* are respectively inserted at the source side of the n-channel FET 81*a* and p-channel FET 82*a* of the constant current control circuits 81 and 82 to decrease the drain current as a result of a decrease in the gate-source voltage in response to an increase in the drain current and to conversely increase the drain current as a result of an increase in the gate-source voltage in response to a decrease in the drain current.

Thus, the drain currents of the n-channel FET 81*a* and p-channel FET 82*a* are controlled at constant currents.

The above-described variable resistors 81*f* and 82*g* for current detection will not increase the charge and discharge time to a problematic level because they can be implemented using parts having very low resistance. However, they advantageously reduce noise in the circuit, which can be particularly desirable in RF circuits, where noise may be picked up as interference. Further, the use of coils 81G and 82*h* in this circuit stabilize the constant current control and help to prevent high-frequency malfunctions of the FETs.

A third embodiment of the present invention will now be described.

Figure 6:
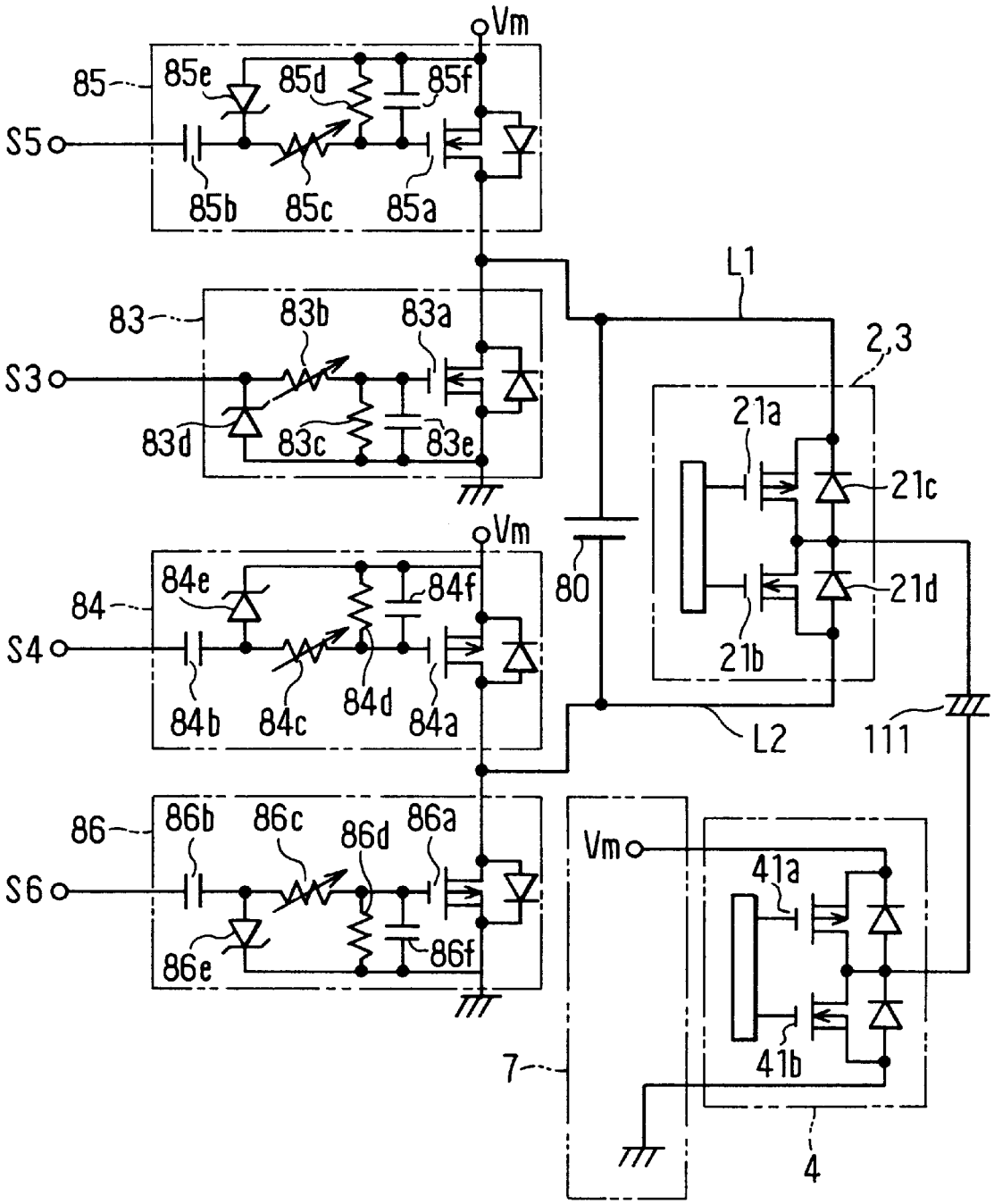
FIG. 6 is a schematic diagram showing a specific configuration of voltage supply circuits in a third preferred embodiment of the present invention.

Although each of the constant current control circuit 81 and 82 performs both charging and discharging in the above embodiments, charging and discharging may be performed using separate constant current control circuits. FIG. 6 shows a configuration for such a case.

In the configuration shown in FIG. 6, four constant current control circuits 83 through 86 are provided. The constant current control circuits 83 and 84 have the same configuration as that of the constant current control circuits 81 and 82 in FIG. 4. The constant current control circuit 85 includes an n-channel FET 85*a,* a coupling capacitor 85*b,* a variable resistor 85*c,* a resistor 85*d,* a Zener diode 85*e* for protecting the input, and a capacitor 85*f* for removing noise. Similarly, the constant current control circuit 86 includes an p-channel FET 86*a,* a coupling capacitor 86*b,* a variable resistor 86*c,* a resistor 86*d,* a Zener diode 86*e* for protecting input, and a capacitor 86*f* for removing noise.

Figures 7A, 7B, 7C, 7D, 7E, 7F, 7G, 7H, 7I, 7J, 7K, 7L, 7M, 7N, 7O:
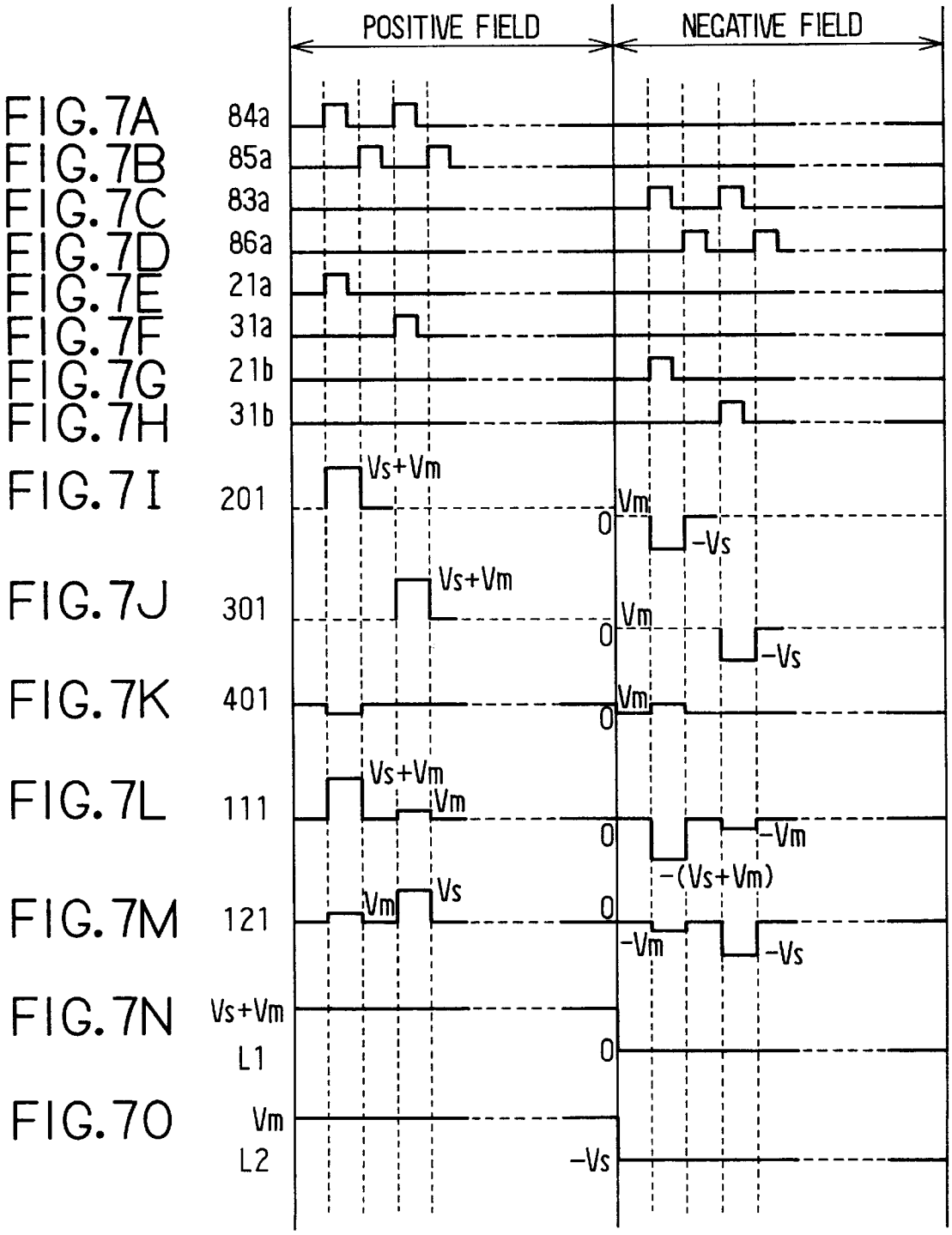
FIGS. 7A–7O are timing charts for the third embodiment.

The constant current control circuits 83 through 86 are turned on in response to control signals from input terminals S3 through S6 and, in the on state, perform constant current control similar to that described above. FIGS. 7A–7O show timing charts for this embodiment.

In the positive field, the p-channel FETs of the scan driver ICs 2 and 3 are sequentially turned on. When the p-channel FETs are turned on, charging is performed by turning only the p-channel FET 84*a* of the constant current control circuit 84 on as shown in FIG. 7A to make the voltage of the scan electrodes equal to (Vs+Vm) as shown in FIGS. 7I and 7J. In discharging, only the n-channel FET 85*a* of the constant current control circuit 85 is turned on as shown in FIG. 7B to make the voltage of the scan electrodes equal to Vm.

In the negative field, the n-channel FETs of the scan driver ICs 2 and 3 are sequentially turned on. When the n-channel FETs are turned on, charging is performed by turning only the n-channel FET 83*a* of the constant current control circuit 83 on as shown in FIG. 7C to make the voltage of the scan electrodes equal to −Vs as shown in FIGS. 7I and 7J. In discharging, only the n-channel FET 86*a* of the constant current control circuit 86 is turned on as shown in FIG. 7D to make the voltage of the scan electrodes equal to the ground voltage.

In this embodiment, since the constant current control circuit for charging and the constant current control circuit for discharging are separately configured, charging and discharging can be reliably performed even when the size of the EL display panel 1 is increased.

A fourth embodiment of the present invention will now be described.

When driving is performed with inverted fields, the voltage of the scan electrodes is kept at a desired reference voltage by performing precharging when field switching occurs. That is, the voltage equals the offset voltage Vm in the positive field and equals the ground voltage in the negative field.

An increase in the size of the EL display panel 1 increases the total capacity of the EL elements, which results in an increase in the time required for precharging if the scan signal supply circuits 5 and 6 are configured using constant current control circuits as in the various embodiments described above. As a result, when line sequential scanning is started before precharging is completed at the time field switching, the scan electrodes for which the precharging has not been completed will have a low scan voltage and hence low intensity. Therefore, variation in intensity occurs at the time of field switching, resulting in a problem in that the quality of display is reduced.

Figure 8:
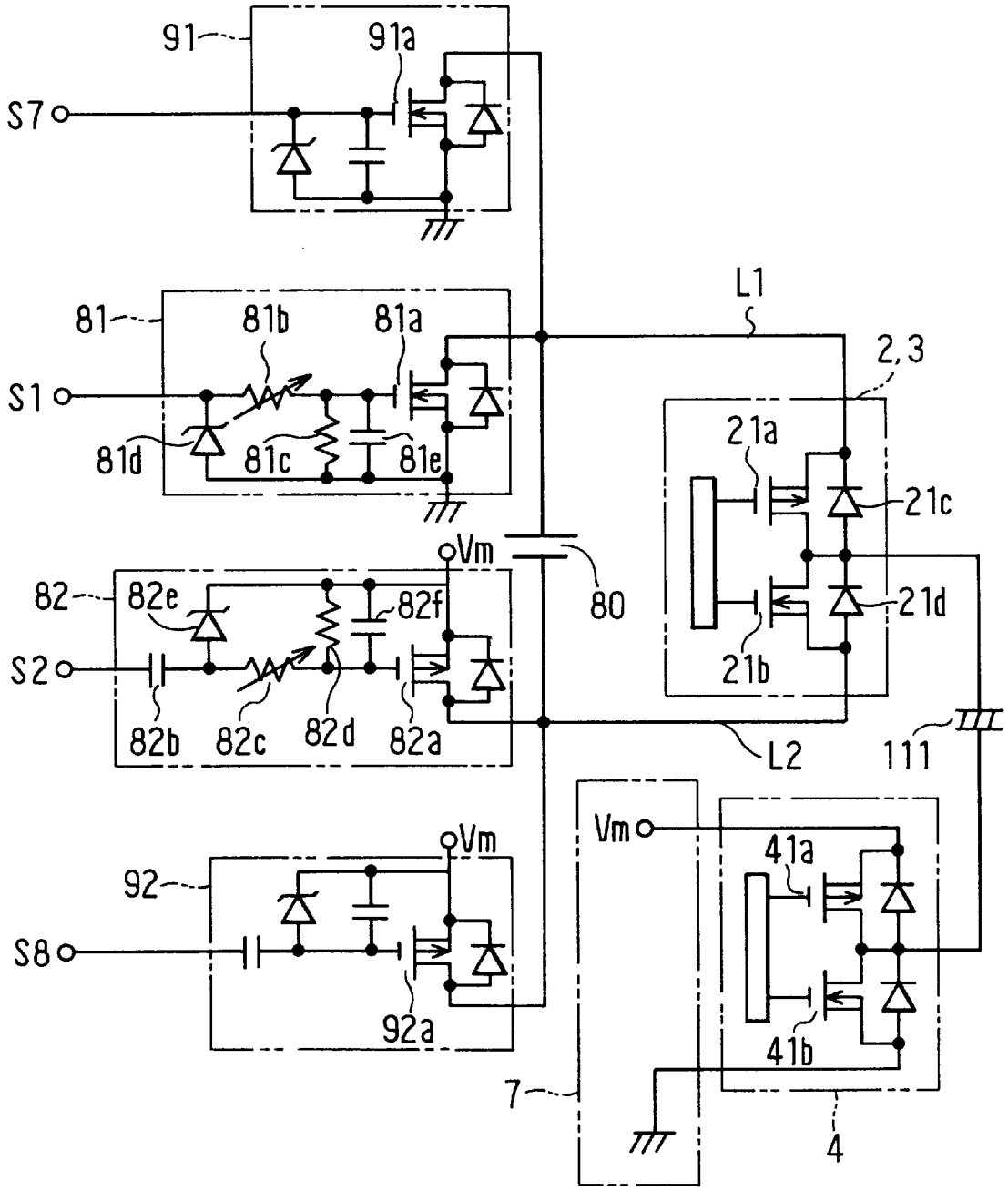
FIG. 8 is a schematic diagram showing a configuration of voltage supply circuits in a fourth preferred embodiment.
Figures 9A, 9B, 9C, 9D, 9E, 9F, 9G, 9H, 9I, 9J, 9K, 9L, 9M, 9N, 9O:
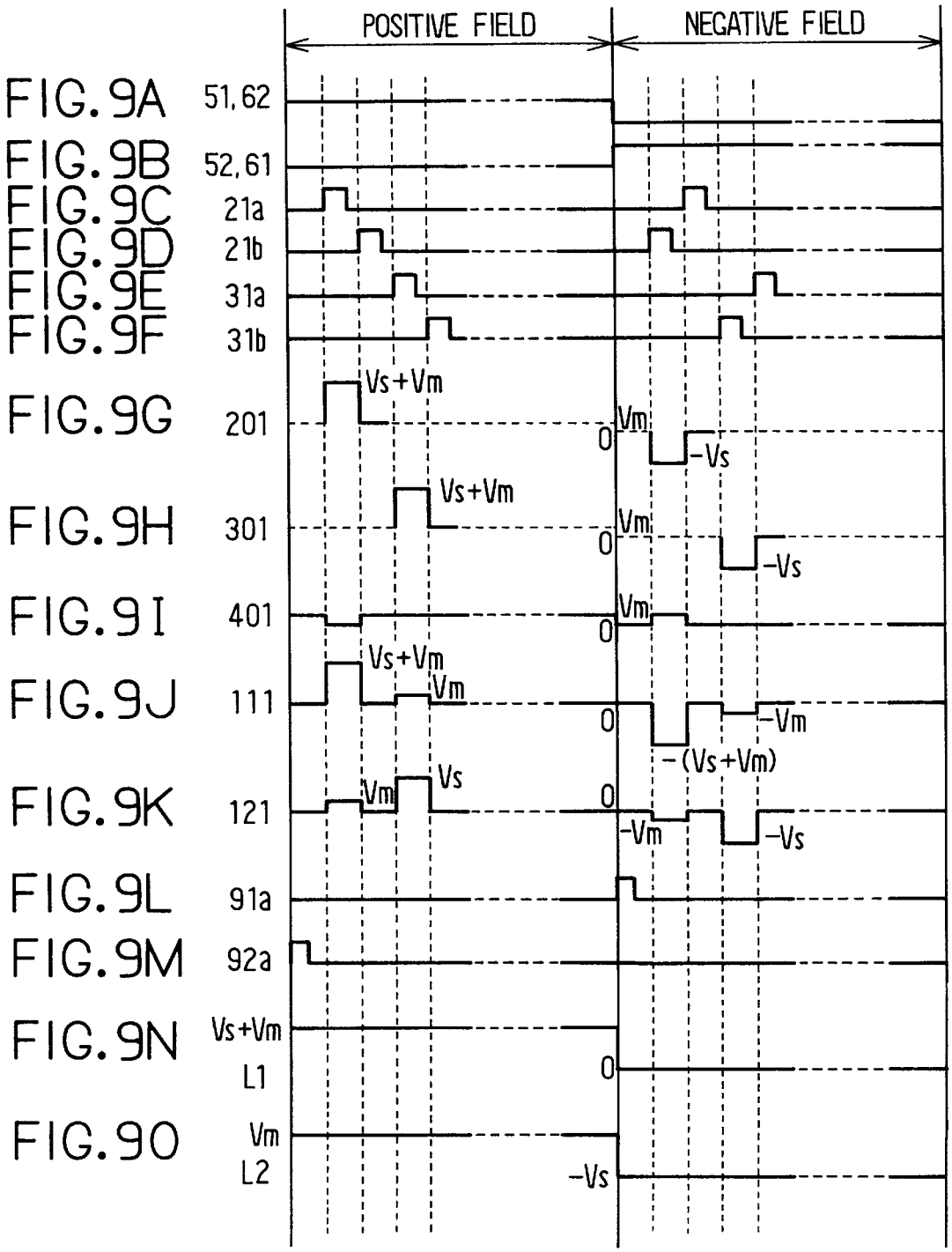
FIGS. 9A–9O are timing charts for the fourth embodiment.

Under such circumstances, according to the present embodiment, precharging circuits 91 and 92 for performing rapid precharging are provided as shown in FIG. 8. FIGS. 9A–9O show timing charts for this embodiment.

The precharging circuit 91 has a configuration wherein the variable resistors 81*b* and 81*c* are eliminated from the constant current control circuit 81 to perform a normal switching operation. When the positive field switches to the negative field, the n-channel FET 91*a* is turned on by a control signal from an input terminal S7 to perform rapid precharging, thereby making the reference voltage of the scan electrodes 201, 301, 202, 302, . . . equal to the ground voltage.

Further, the precharging circuit 92 has a configuration wherein the variable resistors 82*c* and 82*d* are deleted from the constant current control circuit 82 to perform a normal switching operation. When the negative field switches to the positive field, the p-channel FET 92*a* is turned on by a control signal from an input terminal S8 to perform rapid precharging, thereby making the reference voltage of the scan electrodes 201, 301, 202, 302, . . . equal to the offset voltage Vm shown in FIG. 7I.

By performing such rapid precharging, even when constant current control circuits are used in the scan signal supply circuits 5 and 6, the time required for precharging can be reduced to prevent the occurrence of variation in intensity.

The above-described precharging circuits 91 and 92 may be applied to the configurations according to the second and third embodiments.

There are other possible embodiments as follows.

As the switching elements at the output stages of the above-described scan driver ICs 2 and 3 and data driver IC 4, thyristors, bipolar transistors, and the like may be used instead of FETs.

Further, as the switching elements in the constant current control circuits, bipolar transistors, IBGTs, and the like may be used instead of FETs.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An EL display comprising:

an EL display panel having a plurality of scan electrodes on a first side of an EL light-emitting layer, a plurality of data electrodes on a second side thereof, and EL elements in positions where the scan electrodes and the data electrodes intersect each other;

a scan electrode driving circuit for sequentially applying a scan signal having different polarities in each of positive and negative fields to the plurality of scan electrodes; and a data electrode driving circuit for applying a data signal to the plurality of data electrodes;

wherein the scan signal and the data signal cause the plurality of EL elements to selectively emit light;

the scan electrode driving circuit is for applying the scan signal to the scan electrodes by supplying charge and discharge currents to the scan electrodes to charge and discharge the EL elements;

the scan electrode driving circuit includes constant current control circuits for controlling the charge and discharge currents to apply constant currents to the scan electrodes; and wherein the constant current control circuits are positioned separate from the scan electrode driving circuit whereby heat generated by the constant current control circuits is not readily conducted to the scan electrode driving circuit.

2. An EL display according to claim 1, wherein:

the scan electrode driving circuit includes switching elements at an output stage to supply the charge and discharge currents to the scan electrodes; and the constant current control circuits include switching elements in a path of the charge and discharge currents to perform the constant current control.

3. An EL display comprising:

An EL display panel having a plurality of scan electrodes on a first side of an EL light-emitting layer, a plurality of data electrodes on a second side thereof, and EL elements in positions where the scan electrodes and the data electrodes intersect each other;

a scan electrode driving circuit for sequentially applying a scan signal having different polarities in each of positive and negative fields to the plurality of scan electrodes; and a data electrode driving circuit for applying a data signal to the plurality of data electrodes;

wherein the scan signal and the data signal cause the plurality of EL elements to selectively emit light, the scan electrode driving circuit is for applying the scan signal to the scan electrodes by supplying charge and discharge currents to the scan electrodes to charge and discharge the EL elements, the scan electrode driving circuit includes constant current control circuits for controlling the charge and discharge currents to apply constant currents to the scan electrodes;

wherein the scan electrode driving circuit includes switching elements at an output stage to supply the charge and discharge currents to the scan electrodes, the constant current control circuits include switching elements in a path of the charge and discharge currents to perform the constant current control, and the switching elements included in the constant current control circuits are FETs; and wherein the constant current control circuits are for controlling a voltage between gates and sources of the FETs to perform constant current control.

4. An EL display according to claim 3, wherein the constant current control circuits include setting means for setting a gate voltage of respective FETs at a voltage for performing the constant current control.

5. An EL display according to claim 3, wherein the constant current control circuits include resistors for current detection connected at the sources of respective FETs to perform the constant current control.

6. An EL display according to claim 3, wherein the constant current control circuits include:

a first constant current control circuit for controlling the charge and discharge currents at constant currents in a positive field; and a second constant current control circuit for controlling the charge and discharge currents at constant currents in a negative field.

7. An EL display according to claim 6, wherein:

the first constant current control circuit is connected to a first end of a voltage source;

the second constant current control circuit is connected to a second end of the voltage source;

the scan electrode driving circuit is for applying a scan signal having a positive polarity using a voltage from the voltage source to the scan electrodes when the first constant current control circuit performs the constant current control with the second constant current control circuit in a non-operating state; and the scan electrode driving circuit is for applying a scan signal having a negative polarity using a voltage from the voltage source to the scan electrodes when the second constant current control circuit performs the constant current control with the first constant current control circuit in a non-operating state.

8. An EL display according to claim 3, wherein the constant current control circuits include:

a first constant current control circuit for controlling a charge current supplied to the scan electrodes at a constant current in a positive field;

a second constant current control circuit for controlling a discharge current from the scan electrodes at a constant current in the positive field;

a third constant current control circuit for controlling a charge current supplied to the scan electrodes at a constant current in the negative field; and a fourth constant current control circuit for controlling a discharge current from the scan electrodes at a constant current in the negative field.

9. An EL display according to claim 8, wherein:

the first and fourth constant current control circuits are connected to a first end of the voltage source;

the second and third constant current control circuits are connected to a second end of the voltage source;

the scan electrode driving circuit is for forming a charging path for applying a scan signal having a positive polarity utilizing a voltage from the voltage source to the scan electrodes when the first constant current control circuit performs the constant current control with the second, third, and fourth constant current control circuits in a non-operating state;

the scan electrode driving circuit is for forming a discharging path from the scan electrodes which have been charged to the scan signal having a positive polarity when the second constant current control circuit performs the constant current control with the first, third, and fourth constant current control circuits in a non-operating state;

the scan electrode driving circuit is for forming a charging path for applying a scan signal having a negative polarity using a voltage from the voltage source to the scan electrodes when the third constant current control circuit performs the constant current control with the first, second, and fourth constant current control circuits in a non-operating state; and the scan electrode driving circuit is for forming a discharging path from the scan electrodes which have been charged to the scan signal having a negative polarity when the fourth constant current control circuit performs the constant current control with the first, second, and third constant current control circuits in a non-operating state.

10. An EL display according to claim 3, further comprising a precharging circuit for performing precharging of the EL elements only when the positive and negative fields are inverted.

11. An EL display according to claim 10, wherein the precharging circuit includes:

a first precharging circuit for performing the precharging at a time of inversion from the positive field to the negative field; and a second precharging circuit for performing the precharging at a time of inversion from the negative field to the positive field.

12. An EL display according to claim 11, wherein:

said data electrode driving circuit is for generating said data signal to have a modulation voltage determining electro-luminescence of said plurality of EL elements; and said scan electrode driving circuit is for generating said scan signal to include a scan voltage component and a first offset voltage component, each of which is positive in a positive display field, said first offset voltage being equal in magnitude to said modulation voltage.

13. An EL display according to claim 3, wherein:

said data electrode driving circuit is for generating said data signal to have a modulation voltage determining electroluminescence of said plurality of EL elements; and said scan electrode driving circuit is for generating said scan signal to include a scan voltage component and a first offset voltage component, each of which is positive in a positive display field, said first offset voltage being equal in magnitude to said modulation voltage.

14. An EL display according to claim 13, further comprising a precharging circuit for performing precharging of the EL elements when the positive and negative fields are inverted.

15. An EL display according to claim 14, wherein the precharging circuit includes a first precharging circuit for performing the precharging at a time of inversion from the positive field to the negative field, and a second precharging circuit for performing the precharging at a time of inversion from the negative field to the positive field.

16. An EL display according to claim 15, wherein the precharging voltage is equal in magnitude to the first offset voltage.

17. An EL display according to claim 3, wherein said constant current control circuits are disposed serially with respect to said data electrode driving circuits.

18. An EL display comprising:

an EL display panel formed with a plurality of scan electrodes on a first side of an EL light-emitting layer, a plurality of data electrodes on a second side thereof, and EL elements in positions where the scan electrodes and the data electrodes intersect one another;

an offset voltage applying circuit for simultaneously applying to a scan electrode a first offset voltage in a positive field and a reference voltage different from said first offset voltage in a negative field;

a selection voltage generating circuit, connected to the first offset voltage applying circuit, for generating a positive selection voltage sufficient to cause said EL elements to be luminescent by superposing said positive selection voltage on said first offset voltage in said positive field, and for generating a negative selection voltage having a polarity opposite that of the positive selection voltage, said negative selection voltage being insufficient to cause said EL elements to be electroluminescent;

a scan electrode driving circuit connected to the selection voltage generating circuit and the scan electrode driving circuit for, in a positive field, superposing said positive selection voltage on said first offset voltage and applying said superposed voltage to a selected scan electrode, and for, in a negative field, applying a superposition of said reference voltage and said negative selection voltage to said selected scan electrode;

a data electrode driving circuit for, in a positive field, applying said first offset voltage to at least a part of the plurality of data electrodes and applying said reference voltage to a selected data electrode, and in a negative field, applying said reference voltage to a data electrode and applying to said selected data electrode a data voltage having sufficient difference in magnitude from said negative selection voltage to cause an EL element at an intersection of said selected scan electrode and said selected data electrode to be luminescent;

a constant current circuit, connected to said offset voltage applying circuit and disposed in a current flow path thereof, for controlling current generated at a time of switching between said first offset voltage and said reference voltage.

* * * * *